United States Patent [19]

Theurer et al.

[11] 4,010,691

[45] Mar. 8, 1977

[54] BALLAST LEVELING APPARATUS

[75] Inventors: Josef Theurer, Vienna; Karl Folser, Linz-Urfahr, both of Austria

[73] Assignee: Franz Plasser Bahnbaumaschinen-Industriegesellschaft m.b.H., Vienna, Austria

[22] Filed: June 18, 1975

[21] Appl. No.: 587,892

[30] Foreign Application Priority Data

July 5, 1974 Austria ..... 5580/74

[52] U.S. Cl. ..... 104/7 A; 37/104

[51] Int. Cl.[2] ..... E01B 27/02

[58] Field of Search ..... 104/7 A, 7 B, 7 R, 2, 104/4; 37/104, 106, 107; 171/16

[56] References Cited

UNITED STATES PATENTS

| | | | |
|---|---|---|---|
| 1,929,617 | 10/1933 | Walbridge | 104/7 A |
| 2,791,410 | 5/1957 | Allemann | 104/7 A |

FOREIGN PATENTS OR APPLICATIONS

| | | | |
|---|---|---|---|
| 2,057,128 | 6/1971 | Germany | 104/2 |

*Primary Examiner*—Robert J. Spar
*Assistant Examiner*—James M. Slattery
*Attorney, Agent, or Firm*—Kurt Kelman

[57] ABSTRACT

A mobile ballast cleaning machine which comprises a ballast excavating bucket chain and a ballast cleaning screen has a ballast leveling apparatus mounted behind the bucket chain to level cleaned ballast returned to the track bed from the screen. This ballast leveling apparatus consists of an arrangement of bars extending transversely of the track over the entire length of the track ties. The arrangement includes a plurality of transversely arranged rods having adjacent, pivotally joined ends attached to the bucket chain by guide rods or ropes which permit free movement of the leveling rods.

6 Claims, 4 Drawing Figures

BALLAST LEVELING APPARATUS

The present invention relates to improvements in a ballast leveling apparatus mounted on a machine for treating ballast.

A machine of this type and being adapted to move in a working direction on a track including ties resting on a ballast bed is disclosed, for instance in British Pat. No. 1,338,600, published Nov. 28, 1973, or U.S. patent application Ser. No. 96,773, filed Dec. 10, 1970, entitled "Ballast Treating Apparatus". This type of machine comprises a ballast excavating means extending transversely of, and underneath, the track for removing ballast from the ballast bed, a ballast cleaning screen for separating the removed ballast into cleaned ballast and rubble, and conveyor means for conveying the removed ballast from the ballast excavating means to the screen and for conveying the cleaned ballast to underneath the track behind the excavating means in the working direction. In this known machine, a vibratory ballast compactor or like leveling unit is mounted behind the ballast excavating means.

In a machine of this type, little space is available for the ballast leveling apparatus to be mounted behind the excavating point between the preferably lifted track and the cleaned ballast returned to the bed and roughly distributed thereover. It is, therefore, quite difficult to mount and dismount the conventional ballast leveling units. Moreover, these vibratory surface compactors often fail to operate properly because they cannot handle the redistributed cleaned ballast rapidly enough.

It has also been proposed to use rigid plows pulled by the ballast excavating means to level the redistributed ballast. This, too, has failed to provide a substantial improvement over the vibratory surface tampers. It was also found that such plows had to have a frame of considerable height to impart to it a sufficient moment of resistance to avoid bending. It has also been proposed to use a net of chains attached to the ballast excavator for leveling the cleaned ballast behind it. However, such a net must be very heavy to obtain the desired planing effect. In addition, it tends to get caught on the ties or track fastening elements during operation and also to become entangled during mounting on, or dismounting from, the machine. Also, such nets yield readily and, therefore, fail to produce satisfactory ballast leveling.

It is the primary object of this invention to provide a ballast leveling apparatus for a ballast treating machine of the indicated type which operates with a minimum of breakdowns, is readily mounted and dismounted, and provides satisfactory ballast leveling. All of this has been obtained unexpectedly with an exceedingly simple arrangement.

According to the invention, the ballast leveling apparatus consists of an arrangement of bars extending substantially transversely of the track and over the entire length of the track ties. The arrangement includes a plurality of transversely arranged rod-like bars having adjacent, pivotally joined ends, and elongated guide elements, such as rods or ropes or cables, freely movably connect the bars to the machine preferably the ballast excavating means.

The above and other objects, advantages and features of the present invention will become more apparent from the following detailed description of a now preferred embodiment thereof, taken in conjunction with the accompanying drawing wherein FIG. 1 is a schematic side view of a mobile ballast treating machine incorporating the leveling apparatus of this invention;

Figure 1:
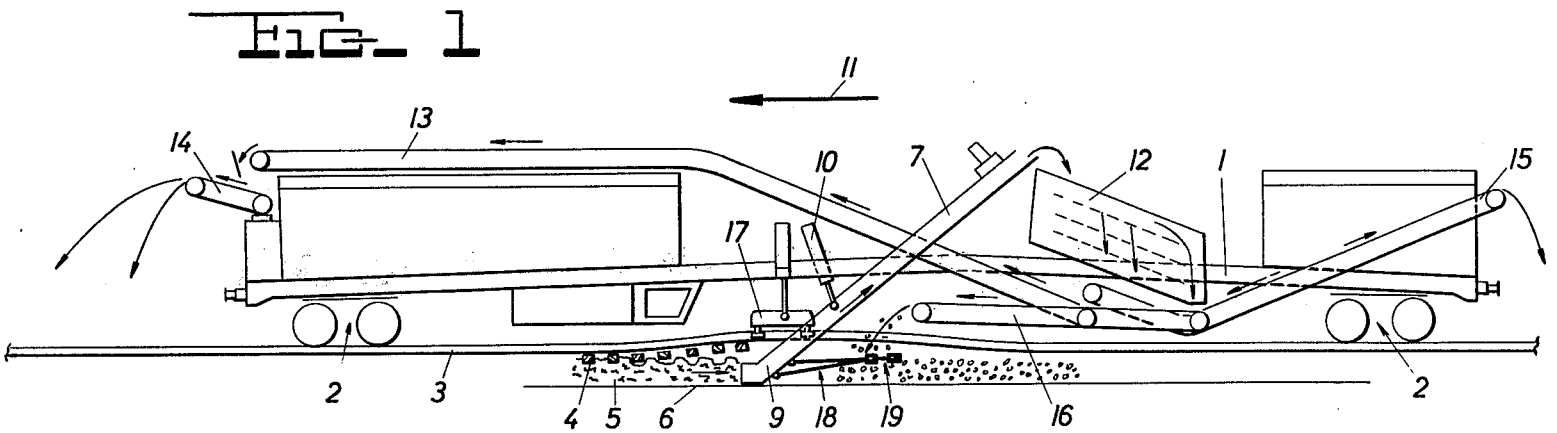
Figure 2:
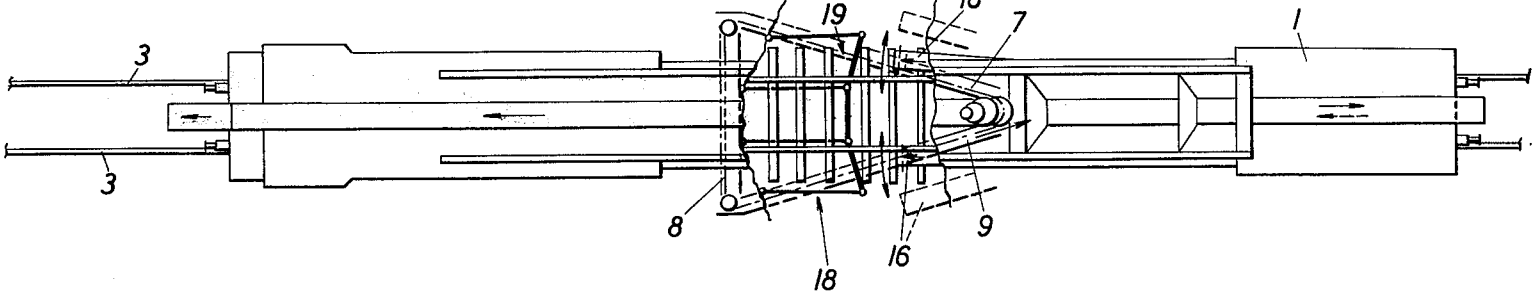
FIG. 2 is a top view of FIG. 1.
Figure 3:
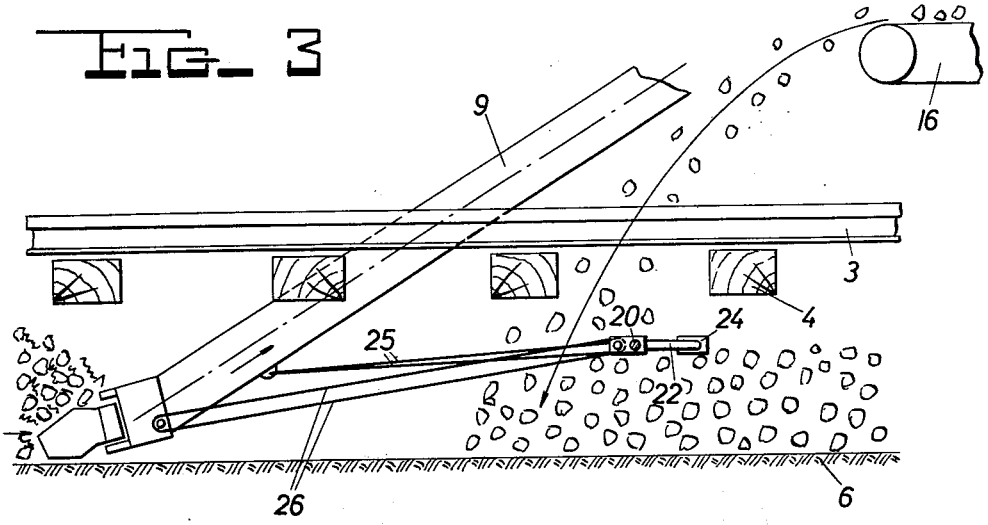
FIG. 3 is an enlarged side view of the leveling apparatus.
Figure 4:
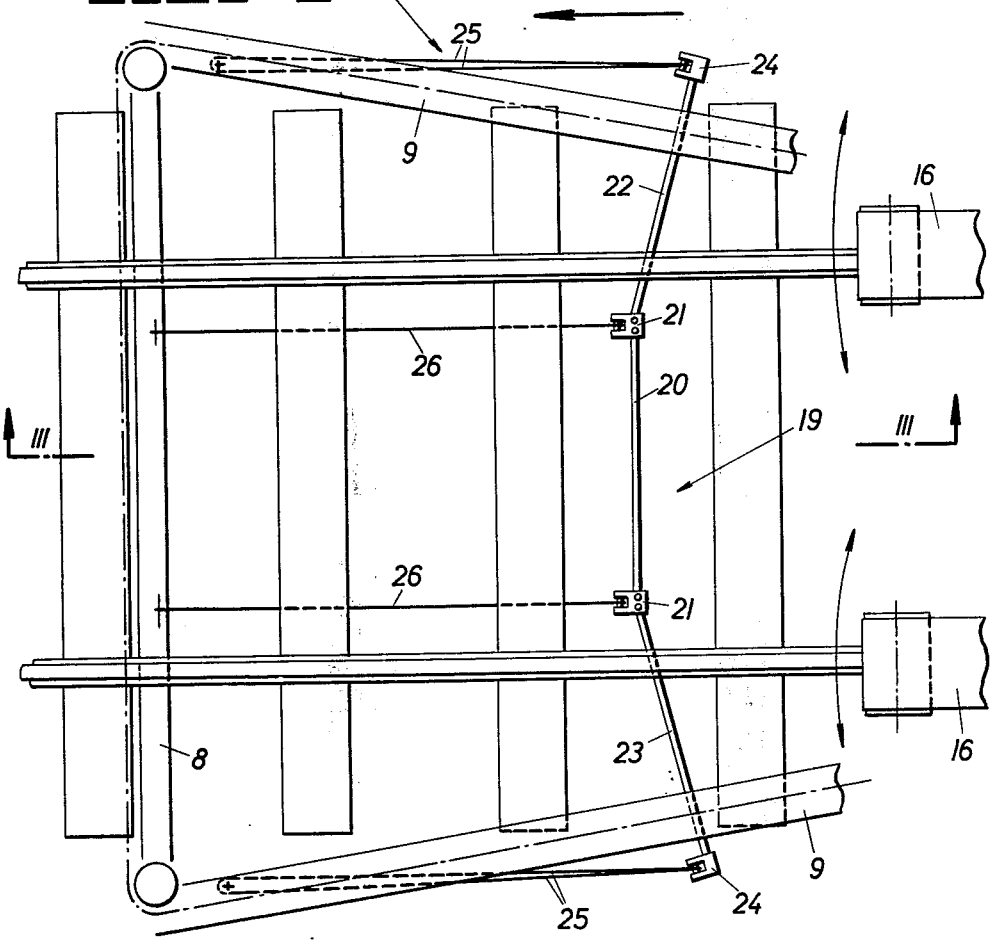
FIG. 4 is a top view thereof, with various parts removed to show the ballast leveling apparatus more clearly.

Referring now to the drawing and first to FIGS. 1 and 2, the ballast treating machine is shown to comprise elongated frame 1 having front and rear undercarriages 2, 2 moving over track 3 fixed to ties 4 resting on ballast bed 5 which is supported on sub-grade 6. In a conventional manner, a ballast excavating means 7 is mounted on the machine frame, the illustrated excavating means being an endless bucket conveyor mounted in guide frame 9 and having a run extending transversely of, and underneath, track 3 for removing ballast from bed 5. Hydraulic jacks 10 enable the excavating mechanism to be horizontally and vertically pivoted. The machine moved on the track in a working direction indicated by horizontal arrow 11 and, in the working direction behind the excavating unit, ballast cleaning screen 12 is mounted on frame 1 to separate the ballast removed from the bed by the excavating unit into cleaned ballast and rubble. The rubble is conveyed away from the screen either to the rear by reversible conveyor 15 or to the front by conveyors 13, 14. The cleaned ballast is conveyed to underneath the track behind the excavating unit 7, 9, in the working direction, by two conveyor bands 16 mounted symmetrically on either side of the track median and being laterally pivotal to distribute the cleaned ballast over the excavated bed, as shown in FIGS. 1 and 3. As also shown in the drawing, the track is lifted during the ballast cleaning operation by track lifting jack 17 mounted on the machine in the region of the ballast excavating means and the leveling apparatus. In a manner which is also known, the track lifting means may serve at the same time for correction of the track position in a lateral and/or vertical direction, i.e. for track lining and/or leveling.

All of the above-described apparatus is more fully described in the above-identified British patent or U.S. patent application.

The ballast leveling apparatus 18 is mounted behind the ballast excavating means for leveling the cleaned ballast so that the track will come to rest with its ties on a leveled bed, after which the cribs between the ties may be filled with ballast, if desired. According to the invention, this apparatus consists of arrangement 19 of bars 20, 22, 23 extending substantially transversely of track 3 and over the entire length of track ties 4. In the illustrated embodiment, the arrangement comprises a central, rod-like bar 20 extending substantially parallel to the ties and two outer rod-like bars 22 and 23. The ends of the central bar are pivotally joined at 21, 21 to respective inner ends of the outer bars, 22, 23. Elongated elements, such as ropes, freely movably connect the bars to transverse guide frame portion 8 of the excavating unit, ropes 25, 25 being attached to outer ends 24, 24 of the outer bars and ropes 26, 26 being attached to the pivotally joined ends 21, 21 of the central bar and outer bars.

In the preferred embodiment illustrated herein, joints 21, 21 connect the adjacent bar ends for pivoting in a plane substantially parallel to the track about a pivot axis extending substantially vertically thereto. Such a structure may be readily mounted in the very narrow space between the track and the ballast, and equally easily removed therefrom, by simply folding the outer bars about their joints. On the other hand, such an arrangement will effectively level the redistributed ballast since the pivotally joined bars are freely movable in the plane of the track so that they can readily adapt to the ballast conditions. On the other hand, they will not move in a direction perpendicular to the track so that they will not get entangled with the track structure.

As shown in the preferred embodiment, outer cables 25, 25 are a little longer than central cables 26, 26 so that, in operation when the bar arrangement is pulled along, outer bars 22, 23 enclose an obtuse angle with central bar 20, with the apex of the angle pointing towards the ballast excavating means. This entire arrangement is very simple in structure and accordingly very economical in production. It provides excellent centering during operation and thus improves the quality of the leveling operation. It enables the leveling to be adapted to the pivoting radii of the ballast conveyors 16, 16 and thus assures excellent distribution and leveling of the cleaned ballast.

To enable the leveling apparatus to be assembled and disassembled rapidly and easily, the adjacent ends of the bars may be joined by bayonet or like joints at their connecting pivots so that the bars may be simply connected and disconnected underneath the track.

If desired, intermediate connecting members may be provided for joining outer bars 22, 23 to central bar 20 so that the outer bars may be spaced from the central bar in the direction of track elongation. Also, to provide a perfect bed for the track ties, the thickness of central leveling bar 20 may differ from that of outer leveling bars 22, 23 or the central bar may be arranged lower than the outer bars in relation to the track plane. This will provide a trough in the center of the leveled ballast bed so that the track ties rest on ballast bed shoulders extending along the central trough.

Also, the leveling effect of the bars will be increased by making the same vibratory. This may be done by using tubes as leveling bars and mounting vibratory drives within the tubes. Alternatively, the leveling bars may be vibrated by any conventional vibrator.

It is also possible to mount a vibratory surface compactor or any other conventional leveling device behind the leveling apparatus of the present invention, in the working direction, without encountering the disadvantages of such devices in known machines. Since the leveling bar arrangement of this invention provides very good ballast leveling, the free space between the track ties and the leveled ballast is increased, thus permitting the additional use of a conventional ballast compactor without difficulties.

It will be obvious from the described embodiment of the invention that the ballast leveling apparatus is exceedingly simple in structure, yet very effective in operation. While the pivotally joined leveling bars yield sufficiently in operation to permit adaptation to various working conditions, the rigidity of the individual bars assure good leveling of the ballast. The entire arrangement may be readily assembled and disassembled, and equally easily mounted on the machine and disconnected therefrom. It requires very little space, which fits it perfectly into the narrow space available between the lifted track and the redistributed cleaned ballast. It assures operation almost without danger of breakdowns.

While the leveling apparatus of the present invention has been illustrated in combination with an endless ballast excavating chain, it may be used with equal effect with other ballast removing means used on known ballast cleaning machines. It may also be used advantageously with track renewal apparatus which may include a ballast cleaning machine or apparatus for conveying fresh ballast to the bed. It could also be used, if the bars are heavy enough, for leveling ballast under a lifted track without cleaning it. It will, therefore, be understood that various changes and variations may occur to those skilled in the art without departing from the spirit and scope of this invention as defined in the appended claims.

What is claimed is:

1. A ballast leveling apparatus mounted on a machine for treating ballast, the machine being adapted to move in a working direction on a track including ties resting on a ballast bed and the machine comprising a ballast excavating means extending transversely of, and underneath, the track for removing ballast from the ballast bed, a guide frame for the ballast excavating means, a ballast cleaning screen for separating the removed ballast into cleaned ballast and rubble, conveyor means for conveying the removed ballast from the ballast excavating means to the screen and for conveying the cleaned ballast to underneath the track behind the excavating means in the working direction, the ballast leveling apparatus being mounted behind the ballast excavating means for leveling the cleaned ballast and consisting of an arrangement of bars extending substantially transversely of the track and over the entire length of the track ties, the arrangement consisting of a central one of rod-like bars extending substantially parallel to the ties and two outer ones of the bars, the ends of the central bar being pivotally joined to respective inner ends of the outer bars, and elongated guide elements freely movably connecting the outer ends of the outer bars and the joined ends of the central and outer bars to the guide frame.

2. The ballast leveling apparatus of claim 1, wherein the elongated guide elements are rods.

3. The ballast leveling apparatus of claim 1, wherein the elongated guide elements are ropes.

4. The ballast leveling apparatus of claim 1, further comprising joints connecting the adjacent bar ends for pivoting in a plane substantially parallel to the track about a pivot axis extending substantially vertically thereto.

5. The ballast leveling apparatus of claim 1, wherein the outer bars enclose an obtuse angle with the central bar, with the apex of the angle pointing towards the ballast excavating means.

6. The ballast leveling apparatus of claim 1, further comprising track lifting means mounted on the machine in the region of the ballast excavating means and leveling apparatus.

* * * * *